US007628187B2

(12) United States Patent
Mittelstaedt

(10) Patent No.: US 7,628,187 B2
(45) Date of Patent: Dec. 8, 2009

(54) CARRYING BAG WITH OVERSKIRT

(76) Inventor: Margo Annette Mittelstaedt, 898 Treasury Bend Dr., Charleston, SC (US) 29412

( * ) Notice: Subject to any disclaimer, the term of this patent is extended or adjusted under 35 U.S.C. 154(b) by 738 days.

(21) Appl. No.: 11/151,117

(22) Filed: Jun. 13, 2005

(65) Prior Publication Data

US 2006/0278311 A1 Dec. 14, 2006

(51) Int. Cl.
*A45C 13/08* (2006.01)

(52) U.S. Cl. ..... 150/105; 150/154

(58) Field of Classification Search ..... 150/105, 150/103, 104, 106, 107, 159, 160; 206/315.3
See application file for complete search history.

(56) References Cited

U.S. PATENT DOCUMENTS

| | | | | |
|---|---|---|---|---|
| 1,815,106 | A | 7/1931 | Jostes | |
| 1,978,971 | A | 10/1934 | Thornhill et al. | |
| 2,008,759 | A * | 7/1935 | Howard | 224/613 |
| 2,023,144 | A | 12/1935 | Miller | |
| 2,053,695 | A | 9/1936 | Buxton | |
| 2,118,400 | A | 5/1938 | Goldberg | |
| 2,131,382 | A | 9/1938 | Lobel | |
| 2,332,808 | A | 10/1943 | Myers | |
| 2,349,926 | A * | 5/1944 | Appel | 150/107 |
| 2,362,807 | A | 11/1944 | Dresner | |
| 2,479,263 | A | 8/1949 | Rohr et al. | |
| D164,621 | S | 9/1951 | Bienen | |
| 2,671,487 | A | 3/1954 | Hoek | |
| 2,672,903 | A | 3/1954 | Machinist | |
| 2,694,427 | A | 11/1954 | Hovis | |
| 2,723,696 | A | 11/1955 | Kase | |
| 2,799,316 | A | 7/1957 | Cohen | |
| 2,845,974 | A * | 8/1958 | Arden | 150/105 |
| 2,893,457 | A | 7/1959 | Wilson | |
| 2,934,122 | A | 4/1960 | Lindsey | |
| 3,031,121 | A | 4/1962 | Chase | |
| 3,234,985 | A | 2/1966 | Gilbert | |
| 3,315,857 | A | 4/1967 | Eclov | |
| 3,349,992 | A * | 10/1967 | Skinner | 150/154 |
| 3,414,033 | A | 12/1968 | Tucker | |
| 3,754,587 | A * | 8/1973 | Rainieri | 150/159 |
| 3,923,222 | A | 12/1975 | Groves | |
| 3,964,529 | A | 6/1976 | Brod | |
| 4,027,710 | A | 6/1977 | Keebler | |
| 4,127,223 | A | 11/1978 | Uchin | |
| 4,498,579 | A * | 2/1985 | Brick | 206/315.4 |
| 4,506,769 | A | 3/1985 | Franco et al. | |
| 4,649,974 | A | 3/1987 | Takanashi | |

(Continued)

*Primary Examiner*—Tri M Mai
(74) *Attorney, Agent, or Firm*—Harleston Law Firm, LLC

(57) ABSTRACT

A versatile, two-piece carrying bag with an overskirt includes: (a) a base bag including at least one central interior compartment and at least one exterior base fastening strap attached at one end to the base bag; (b) a removable overskirt that fits closely over an exterior of the base bag, the overskirt being open at the top and bottom, the base fastening strap extending over a substantial portion of the overskirt; and (c) at least one attachment mechanism attached to the base bag for removably attaching the overskirt to the base bag, the base fastening strap also being removably attachable at an opposite end to the attachment mechanism; wherein the overskirt does not include any attachment mechanism for attaching the overskirt to the base bag. The overskirt is preferably reversible and includes at least one aperture through which a portion of the attachment mechanism is insertable.

10 Claims, 13 Drawing Sheets

U.S. PATENT DOCUMENTS 4,754,790 A 7/1988 Meyers
4,779,314 A 10/1988 Aoki
4,811,769 A 3/1989 Phares
4,825,526 A 5/1989 Shenier et al.
4,856,570 A 8/1989 Rushing et al.
4,883,207 A 11/1989 McArthur
4,907,633 A 3/1990 Eckstein
4,995,436 A 2/1991 Cantor
5,042,116 A 8/1991 Ossiani
5,062,528 A * 11/1991 Whitaker, Jr. ..... 206/315.3
5,154,332 A * 10/1992 Williams et al. ..... 224/153
5,197,525 A 3/1993 Cantor
5,207,254 A 5/1993 Fromm
5,490,619 A 2/1996 Boyar
5,503,204 A 4/1996 Byers et al.
5,505,353 A 4/1996 Marsh, Jr.
5,533,558 A 7/1996 Carey et al.
5,572,773 A 11/1996 Bauer
5,649,581 A 7/1997 Kopel
5,725,039 A 3/1998 Macinai et al.
5,829,502 A 11/1998 Distefano et al.
D403,863 S 1/1999 Briganti
5,881,787 A 3/1999 Davis et al.
5,894,975 A 4/1999 Holden et al.
5,911,262 A 6/1999 Steinhart
5,918,785 A 7/1999 Irose
5,933,926 A 8/1999 Reiter
5,983,969 A 11/1999 Morgan
5,987,715 A 11/1999 Khon
6,003,573 A 12/1999 Owens
6,029,723 A 2/2000 Baquero et al.
6,095,213 A 8/2000 Roegner
6,096,213 A 8/2000 Radovanovic et al.
6,179,025 B1 1/2001 Sutton
6,186,201 B1 2/2001 Salz
6,193,293 B1 2/2001 Ybanez
6,220,318 B1 4/2001 Pinti
6,230,952 B1 5/2001 Jupiter
6,347,730 B1 2/2002 Frederick
6,382,280 B1 5/2002 Sands
6,446,688 B1 9/2002 Sutton
6,547,436 B2 4/2003 Sutton
6,612,350 B1 9/2003 Brynjulfsen
6,820,664 B1 11/2004 Ritch
7,077,251 B1 * 7/2006 Gaither ..... 190/26
2002/0029831 A1 3/2002 Pendergrass
2004/0187988 A1 9/2004 Andrews

* cited by examiner

CARRYING BAG WITH OVERSKIRT

CROSS REFERENCE TO RELATED DOCUMENT

This invention was described in Disclosure Document Number 573816, which was received by the U.S. Patent & Trademark Office on Mar. 30, 2005.

BACKGROUND OF THE INVENTION

1. Technical Field

The present invention relates to a two-piece carrying bag with a removable overskirt that is open at the top and bottom and preferably reversible.

2. Background Information

In a perfect world, a handbag would always match a woman's attire, be useful through all four seasons and differing trends and social occasions. Rotating the contents of one handbag to another handbag that better matches the occasion often results in misplaced items. All too often, there is not enough time before the start of the social/business occasion to rotate a handbag's contents to an alternate handbag. The result of keeping up-to-date with the season and current trends is a backlog of handbags that are no longer a fashionable color, pattern, or style. These out-of-date handbags unfortunately take up space in their owner's bedroom closet until they hopefully become old enough and stylish enough to be called "vintage".

The innovative carrying bag of the present invention provides a fashionable handbag with the versatility required for today's hectic society without the user having to bear the cost of purchasing many handbags. The present invention solves many common handbag dilemmas for the women of today. With the handbag of the present invention, the user can choose colors and patterns that will complement, or contrast with, the particular social occasion or outfit they are wearing that day. The overskirt of the present invention, which is preferably reversible, allows the user to easily change the appearance of a handbag. The reversible overskirt allows a user to tone down an overall outfit or make it more colorful, for example.

The overskirt also increases the endurance of a handbag in that it protects the surface of the base bag. If a face of the base bag becomes soiled, the overskirt can be placed over it. If one face of the overskirt becomes soiled, the overskirt can be reversed. Many overskirts are made of a material that can be cleaned, even if the base bag is not. The overskirt of the present invention can be reversed very quickly and easily in any location where one would bring a carrying bag. The same invention can be employed for other types of carrying bags besides handbags (clutches included), such as computer bags, briefcases, diaper bags, fanny packs, tote bags, knapsacks, and cosmetic bags.

Benefits of the present invention also include the following:

1) The base bag acts as a display for the streamlined overskirt;

2) The base bag can be utilized without the overskirt, if desired;

3) The instant bag has an enhanced appearance and can be matched to the user's ensemble;

4) The overskirt adds significantly to the function of the bag by enhancing durability in adverse weather conditions, and extending wear through different seasons and trends;

5) Where the overskirt includes pockets, additional storage is provided;

6) In one embodiment described herein, the overskirt with pockets can be removed and used separately from the base bag;

7) Reduces the amount of time necessary to dress in the morning because personal items need not be transferred from one handbag to another;

8) Reduces the number of personal items that are lost during transfers between handbags;

9) Frees up closet space because there is no need for maintaining multiple handbags to match different outfits;

10) Saves money because a user can have a good quality bag and still have versatility;

11) Enables a user to show her individuality; and

12) Versatile in that one bag of the present invention can have many different looks.

BRIEF SUMMARY OF THE INVENTION

The present invention is a versatile, two-piece carrying bag with an overskirt for carrying personal articles, which includes:

(a) a base bag comprising at least one central interior compartment and at least one exterior base fastening strap, the base fastening strap being attached at one end to the base bag;

(b) a removable overskirt that fits closely over an exterior of the base bag, the overskirt being open at the top and bottom, the base fastening strap extending over a substantial portion of the overskirt; and (c) at least one attachment mechanism attached to the base bag for removably attaching the overskirt to the base bag, the at least one base fastening strap also being removably attachable at an opposite end to the at least one attachment mechanism;

wherein the overskirt does not comprise any attachment mechanism for attaching the overskirt to the base bag. Preferably, the overskirt is reversible and includes at least one aperture through which a portion of the attachment mechanism is insertable.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
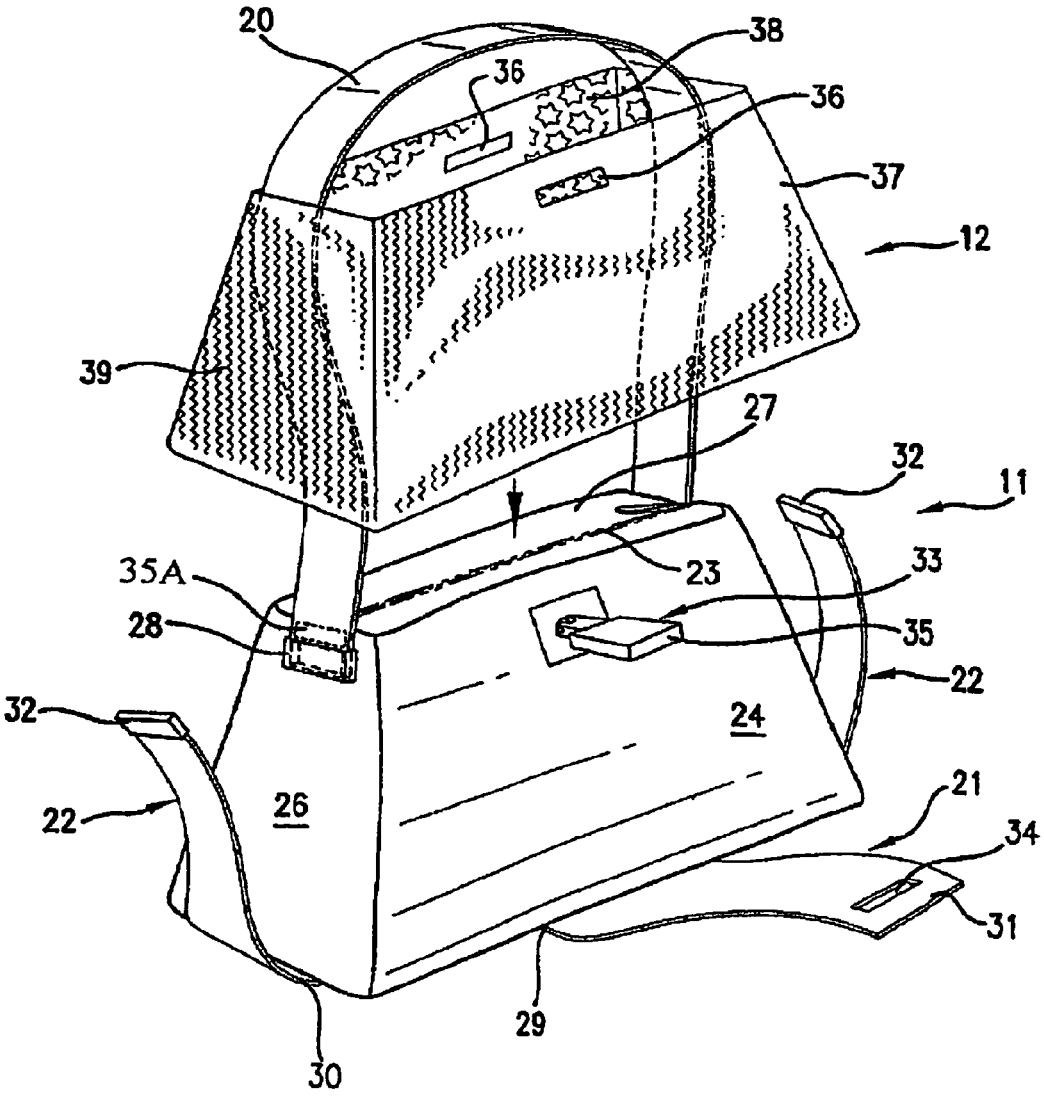
FIG. 1 is a front perspective view of a handbag according to the present invention, shown with the overskirt above the handbag.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Figure 2:
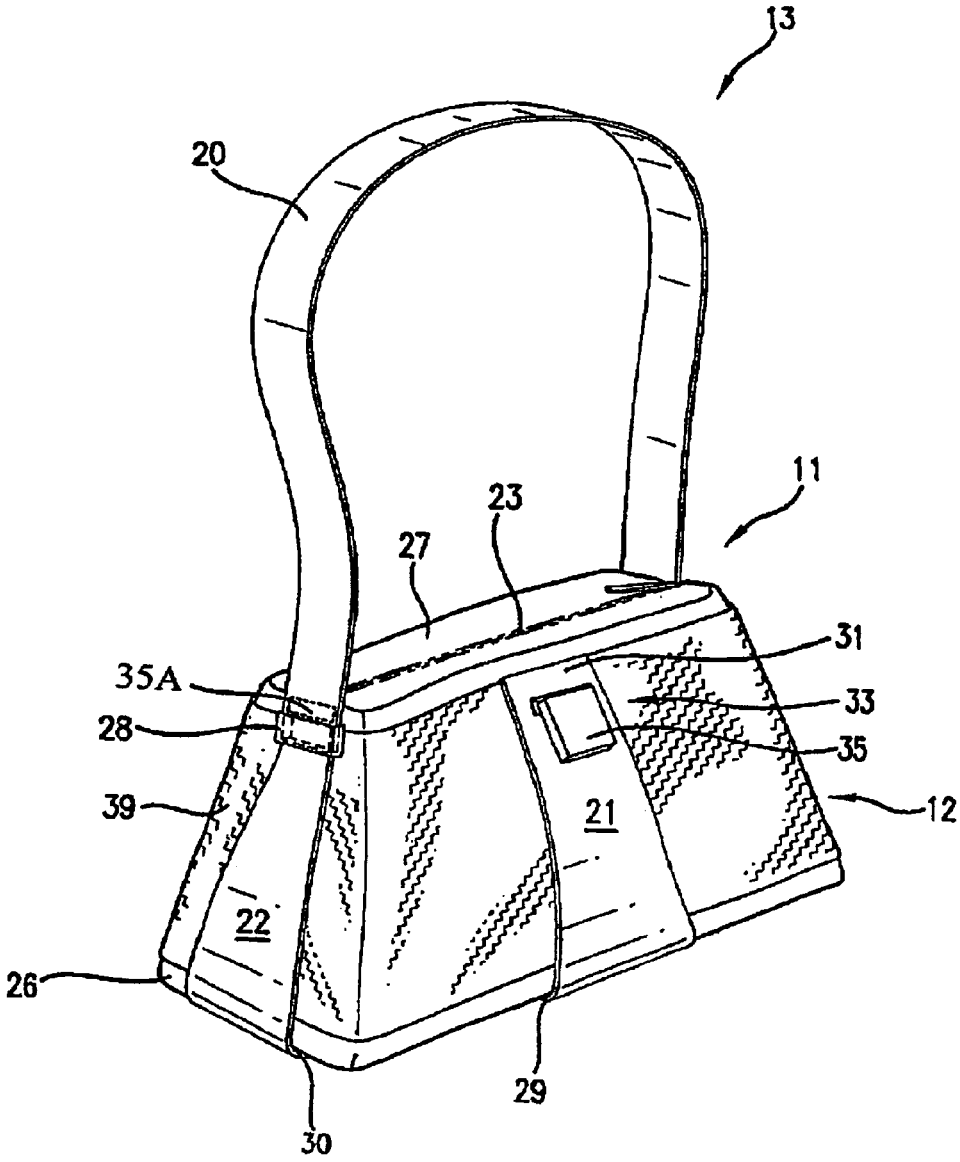
FIG. 2 is a front perspective view of a handbag according to the present invention, shown ready for use.
Figure 3:
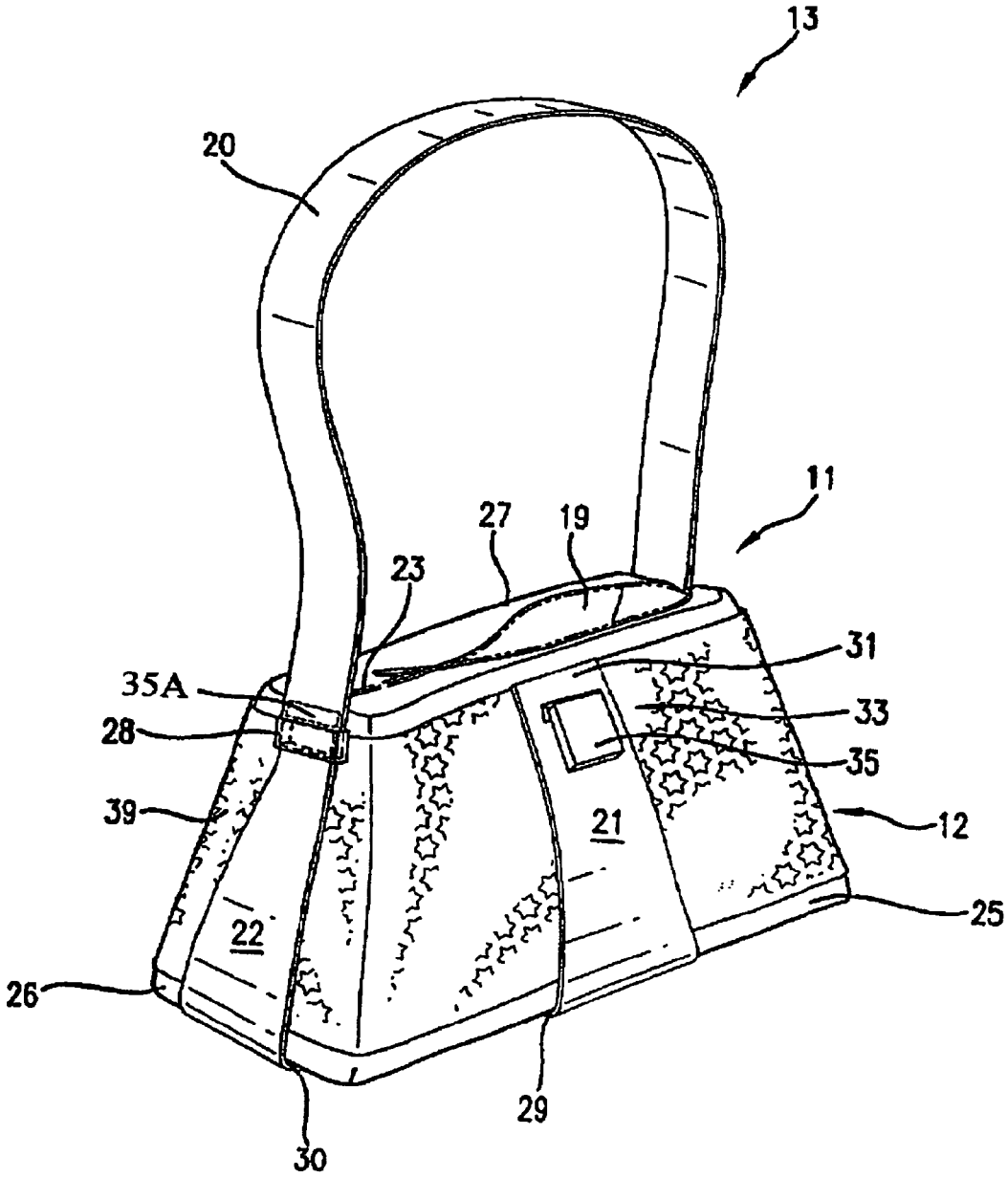
FIG. 3 is a rear perspective view of a handbag according to FIG. 2, shown with the overskirt in a reversed position.

Turning first to FIGS. 1 through 3, a carrying bag according to the present invention, generally referred to herein as 10, comprises a base bag 11 and a reversible, removable overskirt 12. The carrying bag 10 is preferably a handbag 13 (e.g., a clutch handbag) for carrying personal articles. The carrying bag can also be a computer bag 14 for carrying a computer, a briefcase, a diaper bag 15 for carrying baby care items, a tote bag 16, a beach bag 18 with a fanny pack overskirt 17, a knapsack, a cosmetic bag, etc. The overskirt 12 fits closely over the exterior of the base bag 11. When it is in place on the base bag, the overskirt 12 leaves a portion of the base bag 11 visible to the beholder. This is advantageous in that the contrast in patterns or colors of the exterior faces of the base bag and the overskirt is therefore more apparent, and the overall carrying bag is more stylish in appearance. The overskirt 12 can easily be removed and reversed, and replaced on the base bag 11. The base bag 11 can alternatively be used by itself, if desired, with no disadvantages.

The overskirt 12 complements, or contrasts with, the color and/or pattern of the base bag 11. For example, the base bag 11 may be a solid color, with a zigzag pattern on one side of the overskirt 12, as shown in FIG. 2, and a star pattern on the opposite side of the overskirt 12, as shown in FIG. 3. Alternatively, the base bag may be a solid color plastic material, and one side of an accompanying fabric overskirt may be striped, while the opposite side of the overskirt is dotted. Alternatively, the base bag 11 may be made of a brown leather, while the overskirt 12 is made from a textured fabric that has a pattern containing the brown color on one face, and a contrasting bright lime green on the opposite face. This enables the appearance of the carrying bag 10 to be completely changed. False or natural lizard skin, crocodile, pony, fur, etc. may be employed for the base bag 11 or the overskirt 12. Different overskirts 12 may be interchanged for use on a single handbag 13, allowing the user even more choices.

The base bag 11 may be made from leather, fabric, vinyl (e.g., polyvinyl chloride), or any other suitable material. The overskirt 12 may be made from any of these materials. Seam binding, piping, trim, decorative beads, fringe, tassels, feathers, ruffles, tiers, or the like may optionally be attached to the base bag 11 or overskirt 12. Many various types and colors of fabric, decorations, and the like can be utilized, depending on the style of the user. The carrying bag 10 is versatile in that a single bag 10 can have many different looks. For example, a bride can carry a base bag of the present invention with a dressy overskirt and then remove or reverse the overskirt to make the handbag more casual.

As seen in FIG. 3, the base bag 11 comprises at least one central interior compartment 19 for holding the user's personal articles. The central interior compartment 19 may be divided, and the base bag 11 optionally includes several interior compartments and interior pockets (not shown).

As depicted in FIGS. 1 through 3, the central interior compartment 19 is closed and opened by means of a zipper 23 across a top panel 27 of the base bag 11. Other suitable closure mechanisms for closing the base bag 11 can be employed instead of or in addition to the zipper 23, such as slide fasteners, a squeezable clutch closure, hook and loop strips, (magnetic) snaps, and locking fasteners. In the handbag 13 depicted in FIGS. 1-3, the base bag 11 includes a front panel 24, an opposite, matching rear panel 25, and two base bag end panels 26 that match one another, in addition to the base bag top panel 27 and a bottom panel (not shown). The side edges of the generally rectangular shaped base bag front panel 24 are attached to corresponding side edges of the generally rectangular shaped end panels 26, as seen in FIGS. 1-3. The base bag may assume any suitable shape, though. The side edges of the generally rectangular shaped base bag rear panel 25 are attached to opposite, corresponding side edges of the base bag end panels 26. Top edges of the front 24, rear 25, and end panels 26 are attached to the four edges of the top panel 27. Bottom edges of the front 24, rear 25, and end panels 26 are attached to the four edges of the generally rectangular shaped bottom panel (not shown).

As illustrated in FIGS. 1 through 3, the base bag 11, but preferably not the overskirt 12, includes at least one carrying strap 20. In FIGS. 1 through 3, a shoulder strap 20 is attached at its opposite ends 35A to corresponding ends of the base bag 11, such as by sewing, gluing, or the like. The carrying bag 10 need not include a shoulder strap or handles, though. In the handbag 13 shown, each end 35A of the shoulder strap 20 is affixed to a buckle 28. The buckles 28 are attached to upper end portions of the base bag end panels 26.

The preferred base bag 11 also includes at least one base fastening strap 21, 22 attached at one of its ends 29, 30 to a bottom of the base bag 11. There are preferably a front/rear base fastening strap 21 across the approximate center of the front panel 24 (see FIGS. 1 and 2), and a matching one across the approximate center of the rear panel 25 (see FIG. 3). The base bag 11 also preferably includes two narrower, matching end base fastening straps 22 across the approximate longitudinal center of each end panel 26. These straps can be of various shapes, depending on the design of the base bag. The attached ends 29, 30 of the base fastening straps 21, 22 are preferably sewn into the seams around the edges of the bottom panel (not shown) of the base bag 11. Each base fastening strap 21 is fastenable at its opposite, free end 31 to an attachment mechanism 33 on the base bag 11. As shown in FIGS. 1-3, the front and/or rear attachment mechanism 33 is a toggle attachment. The free ends 31 of the front and rear base fastening straps 21 contain apertures 34 sized to correspond to the toggles 35 of the attachment mechanisms 33 on the front and rear panels 24, 25 of the base bags 11. The toggle 35 fits closely through the strap aperture 34. This prevents the overskirt 12 from riding around on the base bag. The toggle or other attachment mechanism 33 is functional, but also attractive and is preferably not hidden from sight. The free end 32 of each end fastening strap 22 is inserted into a hardware plate that fits into the buckle 28 (the end strap fastening mechanism) on the corresponding end panel 26, as shown in FIGS. 1 and 2.

Continuing with FIGS. 1 through 3, the reversible, removable overskirt 12 comprises at least one overskirt aperture 36. The overskirt 12 fits closely over the exterior of the base bag 11. Here, the overskirt 12 is comprised of four sections: a front section 37 and a rear section 38, each attached to two end sections 39, the overskirt 12 being open at the top and bottom. Preferably, the front and rear sections 37, 38 match each other, and the two end sections 39 match each other. The side edges of the front and rear sections 37, 38 are preferably attached to the side edges of the end sections 39. Alternatively, the overskirt 12 is made of one piece of reversible material with one color or pattern on one face, and another color or pattern on its opposite face. The overskirt 12 fits closely over the base bag exterior.

The overskirt 12 is preferably substantially stiff, or free-standing, so that it quickly and easily slides over the base bag. The base bag 11 is preferably substantially free-standing and, once the base fastening straps 21, 22 are attached to the toggle attachment 33 or buckle 28, respectively, the base bag 11 can be used without an overskirt 12. The base bag 11 is a complete carrying bag and can be used on its own (i.e., without an overskirt). When the overskirt 12 is in place on the base bag 11, the front or rear overskirt section 37, 38 overlies the base bag front or rear panel 24, 25, and the overskirt end sections 39 over lie the corresponding base bag end panels 26.

In use, the base fastening straps 21, 22 are unfastened, and the overskirt 12 is pulled down over the base bag 11, as shown in FIG. 1, so that the overskirt apertures 36 are aligned with the toggles 35 of the attachment mechanisms 33 on the front and rear panels 24, 25 of the base bag 11. The fastening strap apertures 34 of the front and rear base fastening straps 21 are then aligned with the toggles 35, and the toggles 35 are depressed. The free ends 32 of the end base fastening straps 22 are then fastened to the buckles 28 at the top ends of the end panels 26, as shown in FIG. 2. The base fastening straps 21, 22, thus hold the overskirt 12 in place until the user decides to again change the look of the carrying bag 10. Since the overskirt 12 is slightly shorter than the front and rear panels 24, 25 of the base bag 11, upper and lower portions of the front and rear panels 24, 25, as well as the end panels 26 of the base bag, are stylishly visible below and above the overskirt 12, as seen in FIGS. 2 and 3. The base bag therefore serves to display the contrasting or complementary pattern of the overskirt. This may also be done for other carrying bags 10 according to the present invention.

The reversible overskirt 12 is simple and does not include any hardware for affixing the overskirt to the base bag. The hardware for removably attaching the overskirt 12 to the base bag 11 is provided on the base bag. The overskirt 12 may carry decorative hardware, though, such as chains, mail, buckles, or studs.

In use, the user selects a desired style of base bag 11 and overskirts 12 that are an aesthetically desirable color and style. The color and pattern of the base bag 11 and overskirt 12 may be similar to one another or contrasting. The present carrying bag 10 can be easily modified at will to coordinate with the user's outfit, the imminent social event, seasonal changes, or daily weather conditions. For example, an overskirt made of a waterproof material, such as a vinyl, can be used in rainy weather or near water (e.g., pool, water park, lake, beach), especially over a base bag made of a delicate material, such as suede or silk. Conversely, a protective overskirt of a water absorbent material such as terry cloth can be used in a pool, lake, or beach area, for example.

The attachment mechanism 33 on the handbag exteriors is incorporated into the overall design of the handbags 13, allowing the attachment mechanism to be used without distracting from the attractiveness of the handbag. This attachment mechanism feature may be made out of the same material as the handbag 13, or out of complementary materials or hardware, so that the base fastening strap 21 and attachment mechanism 33 add to the overall design or appearance of the handbag 13. At least one attachment mechanism 33 is positioned on the handbag 13 in an aesthetically appropriate location corresponding to an aperture of the base fastening strap 21. In addition to enhancing the attractiveness of the handbag 13, the attachment mechanism 33 serves the purpose of locking the reversible overskirt 12 into place via the base fastening strap 21, as desired. The exterior attachment mechanism 33 may be released from the top, bottom, or sides to allow the overskirt 12 to be incorporated appropriately, depending on the design of the handbag 13.

Interchangeable overskirts 12 may be selectively incorporated onto the handbag 13 via the exterior attachment mechanism 33, serving the purpose of adding a variety of colors, patterns, and/or textures to the existing handbag 13 when so desired. The interchangeable overskirt also provides additional storage and durability. The overskirt 12 may be shaped so as to enhance the overall appearance of the variety of corresponding handbag designs available. The overskirt 12 may be secured to the handbag 13 by sliding it over the exterior base bag 11, moving the base fastening strap 21 into place, and fastening the exterior attachment mechanism 33. The corresponding base fastening strap 21 ensures that the overskirt 12 maintains its position on the handbag 13, and prevents undesired slippage of the overskirt 12. The reversible overskirt 12 may be made out of a variety of materials to allow individualization of the overall handbag appearance. The overskirt 12 may have complementary trim, or an exterior feature such as a pocket. The overskirt 12 can be shaped to enhance the corresponding handbag 13 with its releasable attachment mechanism 33.

Figure 4:
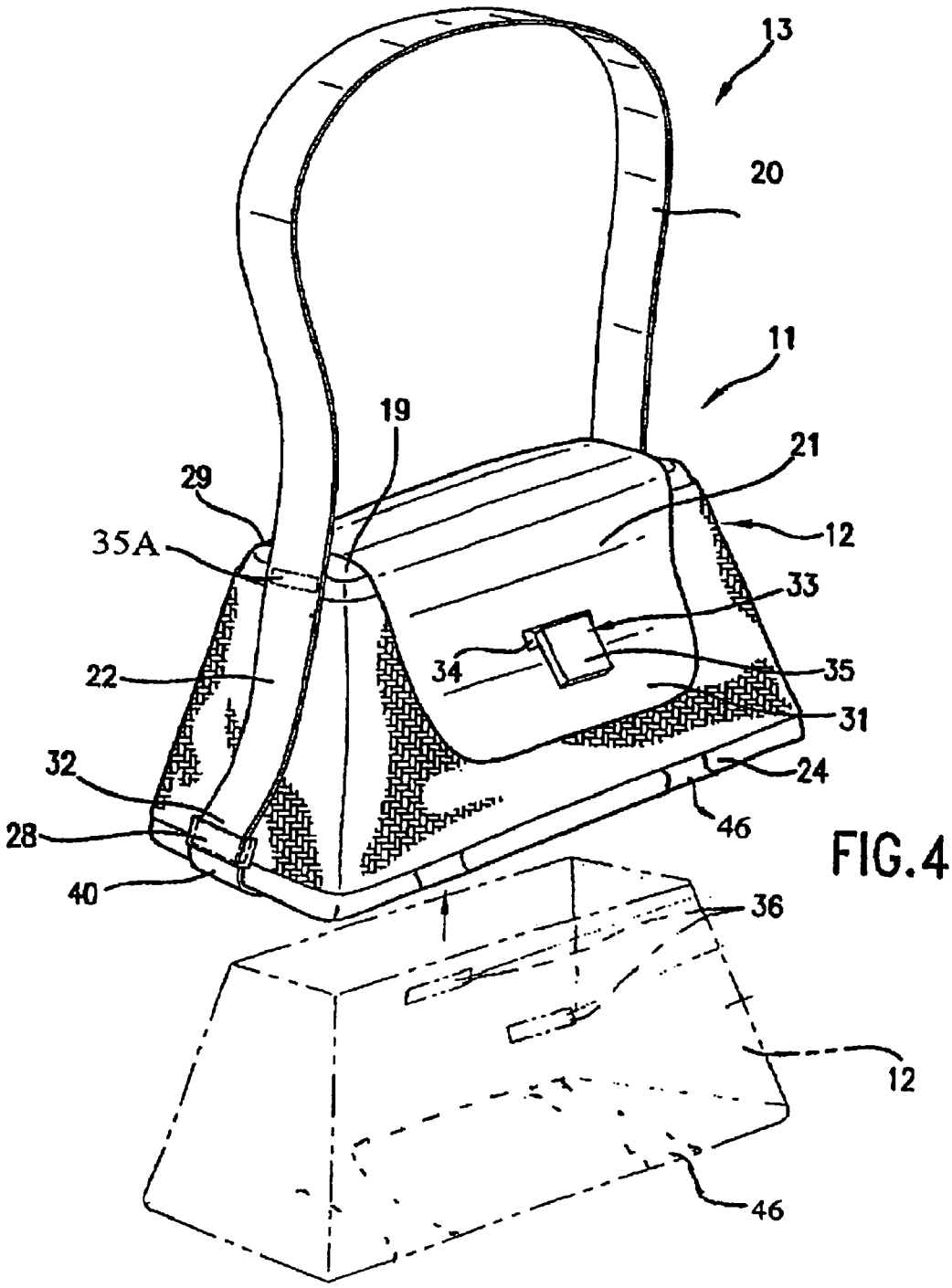
FIG. 4 is a perspective view of a handbag according to the present invention, shown with the overskirt underneath the handbag.

Turning to FIG. 4, the handbag 13 comprises a front base fastening strap 21 with one end 29 attached to the top edge of the rear panel 25 of the base bag 11. Here, the front base fastening strap 21 serves as a flexible flap that covers the open central compartment 19. A conventional zipper may also be employed under the base fastening strap 22 to close the central interior compartment 19 (as seen in FIGS. 1-3). The base fastening strap 21 may alternatively be a rigid top cover, which may have a built-in mirror attached to the inside of the cover/base fastening strap.

To put it on, the overskirt 12 is pulled up over the bottom of the base bag 11 (see outlined overskirt in FIG. 4). The open top of the overskirt 12 is pulled over the bottom of the base bag, and the toggles 35 on the front and rear panels 24, 25 of the base bag 11 are extended through generally rectangular-shaped overskirt apertures 36. The opposite, free end 31 of the base fastening strap 21 includes a strap aperture 34 that fits closely over the toggle 35 of the toggle attachment mechanism 33 attached to the base bag front panel 24. A toggle attachment mechanism 33 is also attached to the rear panel 25 of the base bag 11 (not shown). The toggle 35 of the front attachment mechanism 33 extends through the overskirt aperture 36 and then through the strap aperture 34. The toggles 35 and the base fastening strap 21 hold the overskirt 12 in place on the handbag 13.

Optional bikini strips 46 extending across the open bottom of the overskirt 12 from the front overskirt section to the rear overskirt section also serve to prevent the overskirt from riding up on the handbag 13. The bikini strips 46 also present a visual contrast when the handbag 13 is being carried and the bottom of the bag is visible.

With continued attention to FIG. 4, the handbag 13 further comprises end base fastening straps 22 that continue down from the shoulder strap 20. The ends 35A of the shoulder strap 20 are attached to the top end portions of the end panels 26 of the base bag 11, preferably by sewing or gluing. Once the overskirt 12 is on the base bag 11, the free ends 32 of the end base fastening straps 22 are buckled into end buckles 28 near the bottom of the base bag. The end buckles 28 are attached to short straps 40 on each end of the handbag, each with an end sewn into a bottom end seam. Other attachment mechanisms may be employed instead of buckles. The end fastening straps 22 and end buckles 28 help to hold the overskirt 12 in place on the base bag 11. This may also be done for other carrying bags 10 according to the present invention. To remove the overskirt, the user unfastens the end buckles 28, unfastens the toggles 35, pulls the toggles 35 out of the overskirt apertures 36, lifts up the front base fastening strap 21, and slides the overskirt 12 down over the bottom of the handbag 11.

Figure 5:
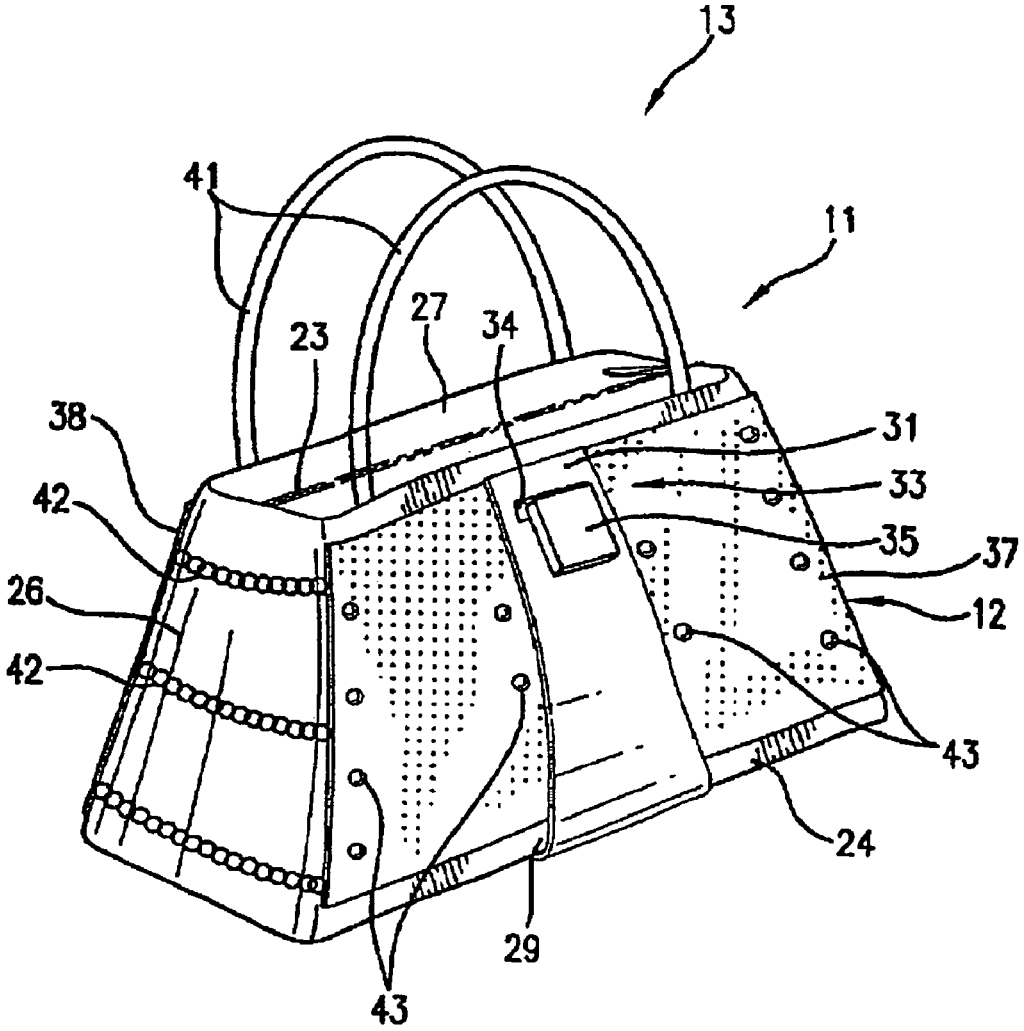
FIG. 5 is a perspective view of a handbag according to the present invention, shown ready for use.

Referring to FIG. 5, a handbag 13 includes handles 41 for carrying the handbag. The ends of the handles 13 are affixed to the top edges of the front and rear panels 24, 25 of the base bag 11. The handles 41 may be made of any suitable material, including leather, plastic, rope, chain, or hardware items.

In the handbag of FIG. 5, a conventional zipper 23 for closing the interior compartment 19 extends the length of the top panel 27. The attached end 29 of the front fastening strap 21 is sewn into the bottom seam, and the opposite, free end 31 of the strap 21 includes a strap aperture 34 through which a toggle 35 of the front attachment mechanism 33 is extendible. The free end 31 of the base fastening strap 21 preferably extends to the top of the overskirt 12 for a neat line.

Continuing with FIG. 5, the overskirt 12 includes three short metal chains 42 on each end instead of solid end sections. No end fastening straps are employed here. The chains 42 extend over the base bag end panels 26 from a side edge of the overskirt front section 37 to the corresponding side edge of the overskirt rear section 38. In addition to helping to hold the overskirt 12 on the base bag 11, the chains 42 add a decorative element to the handbag 13. The front and rear overskirt sections 37, 38 also include decorative studs 43, which complement the chain motif. The overskirt may or may not be reversible.

Figure 6:
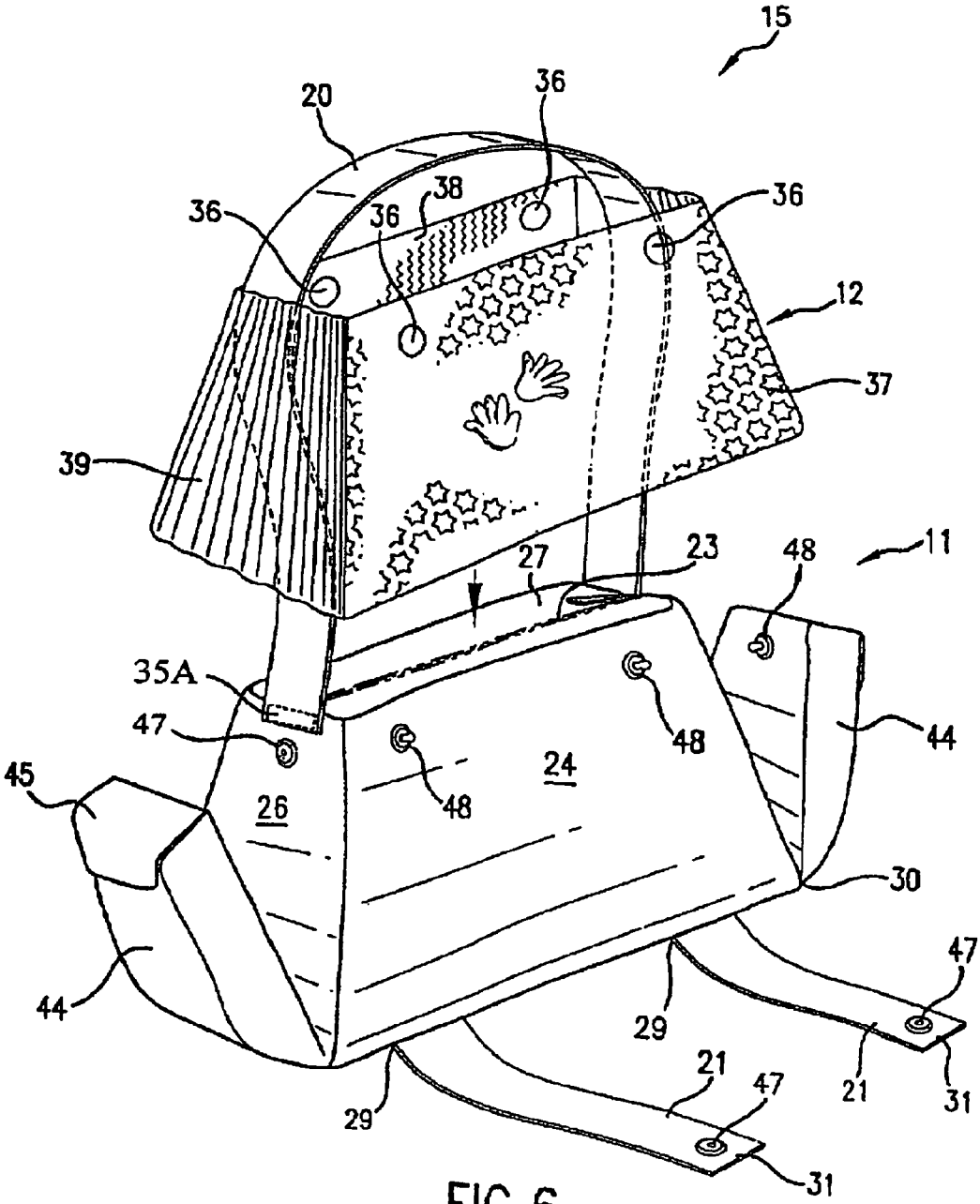
FIG. 6 is a perspective view of a diaper bag according to the present invention, shown with end pockets.

Turning to FIG. 6, a diaper bag 15 includes a shoulder strap 20 for carrying it. The ends 35A of the shoulder strap 20 are sewn to the end panels of the base bag. Female clasp members 47 are attached to top portions of the base bag end panels 26. An end pocket 44 is integral with each end fastening strap. The attached ends of the two end pockets 44 are attached to the bottom of the base bag at the ends. Pocket flaps 45 cover the end pockets 44, which are handy for carrying baby bottles, keys, small toys, etc. A male clasp member 48 is affixed to the rear of each end pocket 44 at the top. The male clasp members 48 are insertable in the female clasp members 47 on the base bag.

As seen in FIG. 6, a conventional zipper 23 for closing the interior compartment 19 extends the length of the top panel 27. Two front base fastening straps 21 are affixed at their lower, attached ends 29 to the bottom of the base bag 11. Female clasp members 47 in the free ends 31 of the two base fastening straps 21 clasp to corresponding male clasp members 48, which are affixed to the base front panel 24. The rear of the bag is the same as the front.

Continuing with FIG. 6, the overskirt 12 includes two matching, circular-shaped apertures 36 in the overskirt front section 37, and two matching apertures 36 in the overskirt rear section 38. The overskirt apertures 36 correspond in size to the clasp members 47, 48. Before using the diaper bag 15, the overskirt 12 is pulled down over the shoulder strap 20 and the base bag 11 (but not the end pockets 44), so the overskirt apertures 36 are aligned with the male clasp members 48. Here, the overskirt end sections 39 are made of an elasticized material to ensure a tight fit over the base bag 11. The front and rear base fastening straps 21 are then lifted up over the overskirt 12 and the female clasp members 47 are removably affixed to the male clasp members 48. The end pockets 44 are lifted up over the overskirt 12 and the male clasp members 48 are pressed into the female clasp members 47. The end clasp members are preferably either above the top edge of the overskirt, or the overskirt includes circular-shaped apertures in the overskirt end sections 39 to accommodate the end clasp members 47, 48.

Different photographs are preferably printed on the faces of the overskirt 12 of the diaper bag 15. The front and rear base fastening straps 21 are preferably made of a clear vinyl material, so the photographs are visible through the base fastening straps. Instead of having photographs on the overskirt, an optional decorating kit can be supplied with the carrying bag 10 for painting and/or decorating the overskirt 12. For example, the decorating kit may include washable finger paints for applying the child's handprints on the overskirt 12, which is made of a suitable material.

The diaper bag 15 may come with a toy, such as large plastic toy keys, attached to a safe ring in a pocket of the overskirt or base bag. A toddler can play with the attached toy in church, at a restaurant, etc., without losing the toy. Of course, the toy is stored in the pocket when it is not in use.

Figure 7:
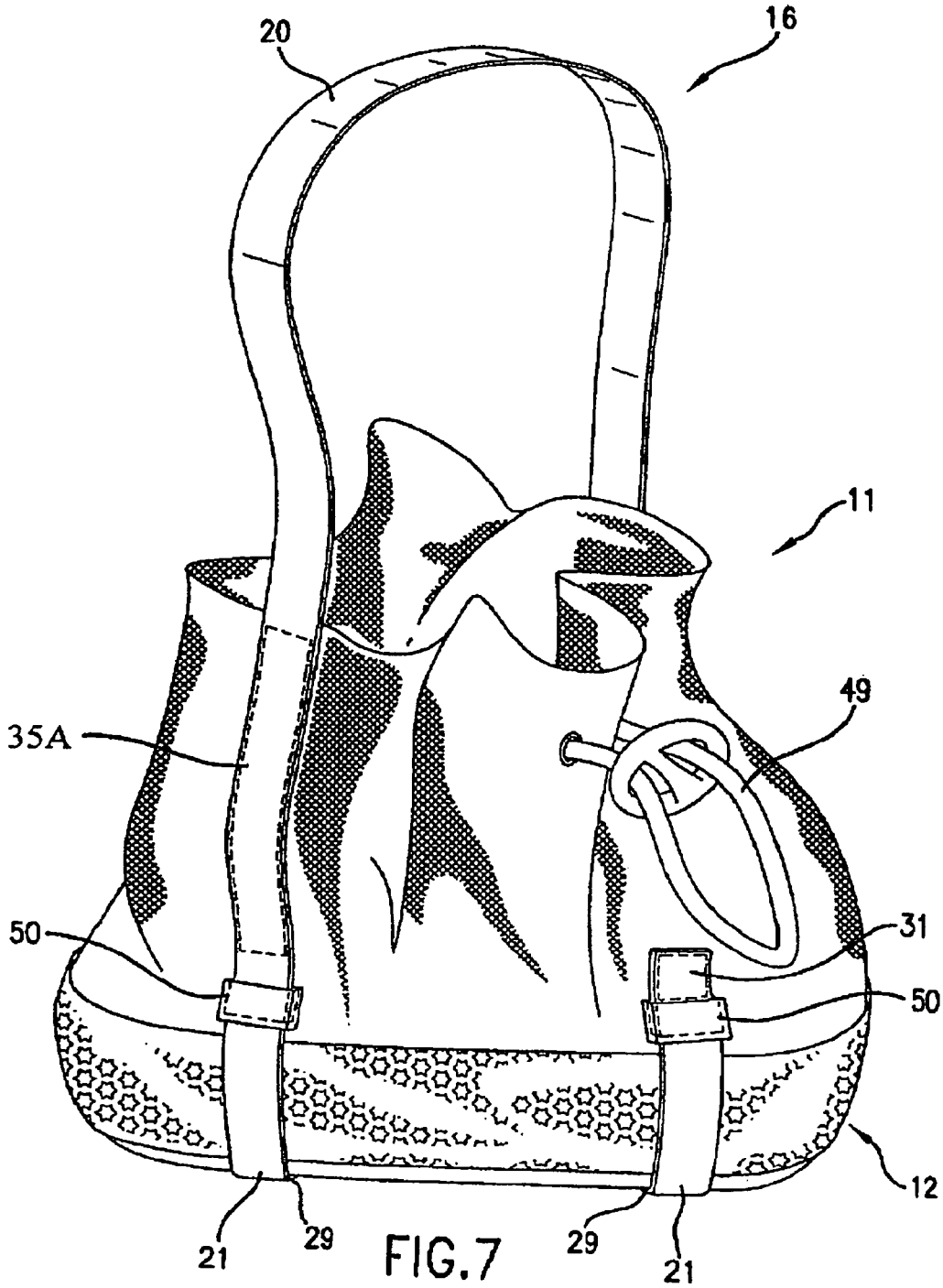
FIG. 7 is a perspective view of a tote bag according to the present invention, shown in an assembled state.

Referring to FIG. 7, a relatively circular shaped, flexible tote bag 16 comprises a base bag 11 and an abbreviated overskirt 12. A draw cord 49 through a seam in the base bag is used to open and close the central compartment 19 of the tote bag 16. The tote bag 16 includes a shoulder strap 20. The ends 35A of the shoulder strap are sewn to the base bag 11.

Base fastening straps 21 are attached at a lower, attached end 29 to the bottom of the base bag 11, as shown in FIG. 7. There are preferably four base fastening straps 21, two of which are positioned below the ends 35A of the shoulder strap 20, as seen in FIG. 7. Corresponding strips of hook and loop material 50 are affixed to a free end 31 of the fastening straps 21 and to the base bag exterior. Once the reversible, ring-shaped overskirt is pulled down, or up, over the bottom portion of the base bag, the hook and loop strips 50 on the free ends 31 of the base fastening straps 21 are pressed onto the corresponding strips of hook and loop material to hold the overskirt in place. The ring-shaped overskirt 12 is preferably made of a stretchy material so that it can be used independently of the base bag 11 as a belt or the like. The overskirt 12 is easy to replace on the base bag.

Figure 8A:
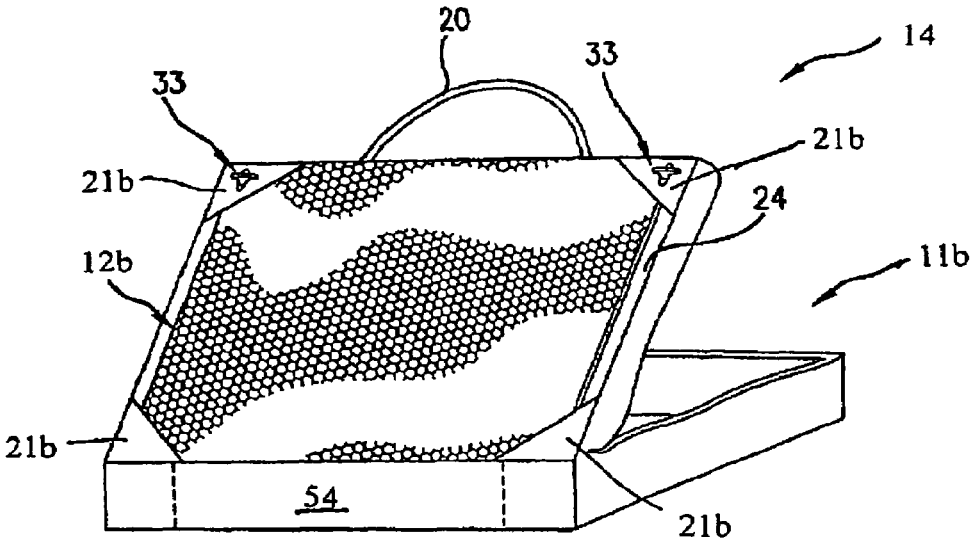
FIGS. 8A/B are perspective views of a computer bag and overskirt according to the present invention, shown ready for use.
Figure 8B:
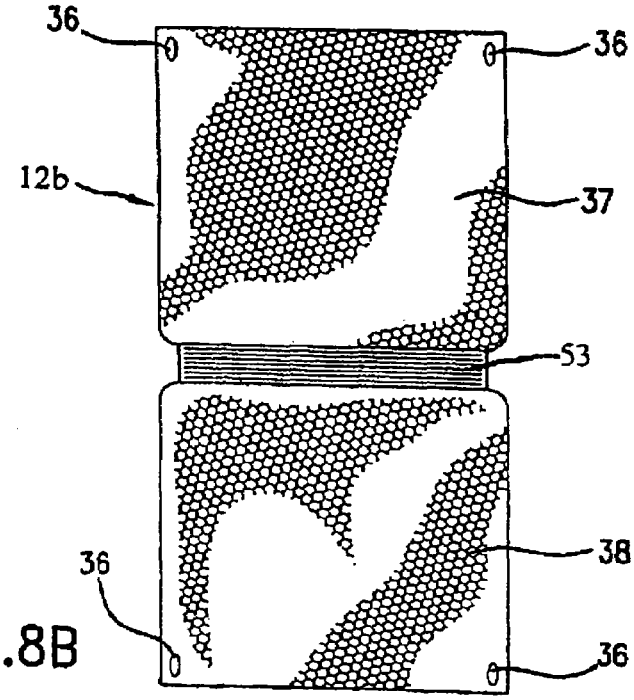

Turning now to FIGS. 8A&B, a briefcase or computer bag 14 for carrying a laptop computer comprises carrying straps 20, and a generally rectangular shaped and planar, reversible overskirt 12*b*. As seen in FIG. 8B, the overskirt 12*b* includes a central, elasticized insert 53, which connects front and rear overskirt sections 37, 38. The front and rear overskirt sections 37, 38 each include two matching overskirt apertures 36 along an outer edge for accommodating a portion of the attachment mechanisms 33 on the front and rear panels 24, 25 of the computer base bag 11*b*. Here, the front and rear base fastening straps are generally triangular-shaped corner straps 21*b* that extends across the four corners of the front panel 24 and the duplicate four corners of the rear panel 25 (not shown) of the base bag 11*b*.

To use the overskirt 12*b*, the two corners of the overskirt front section 37 are slipped under the two corner straps 21*b* of the base bag 11*b*, with an overskirt aperture 36 over each attachment mechanism 33, which are attached on the corners of the front panel 24 of the base bag. The rear overskirt section 38 is then slipped under the computer base bag flap 54, which has a detached central portion as indicated by the hidden lines in FIG. 8A. The two outer corners of the rear overskirt section 38 are then inserted into the matching corner straps 21*b* on the base bag rear panel, with the attachment mechanisms 33 being inserted through the overskirt apertures 36. The four attachment mechanisms are then turned to the "lock" position, as shown in FIG. 8A.

The overskirt 12*b* can easily be removed from the computer bag 14 by unlocking the four attachment mechanisms 33, pulling the outer overskirt corners out of the corner straps 21*b*, and sliding the overskirt 12*b* through the computer base bag flap 54. The reversible overskirt 12*b* may have a business-like pattern or color on one side for use during business hours, and a casual pattern or color on the other side for use during weekends, vacations, etc.

Figure 9:
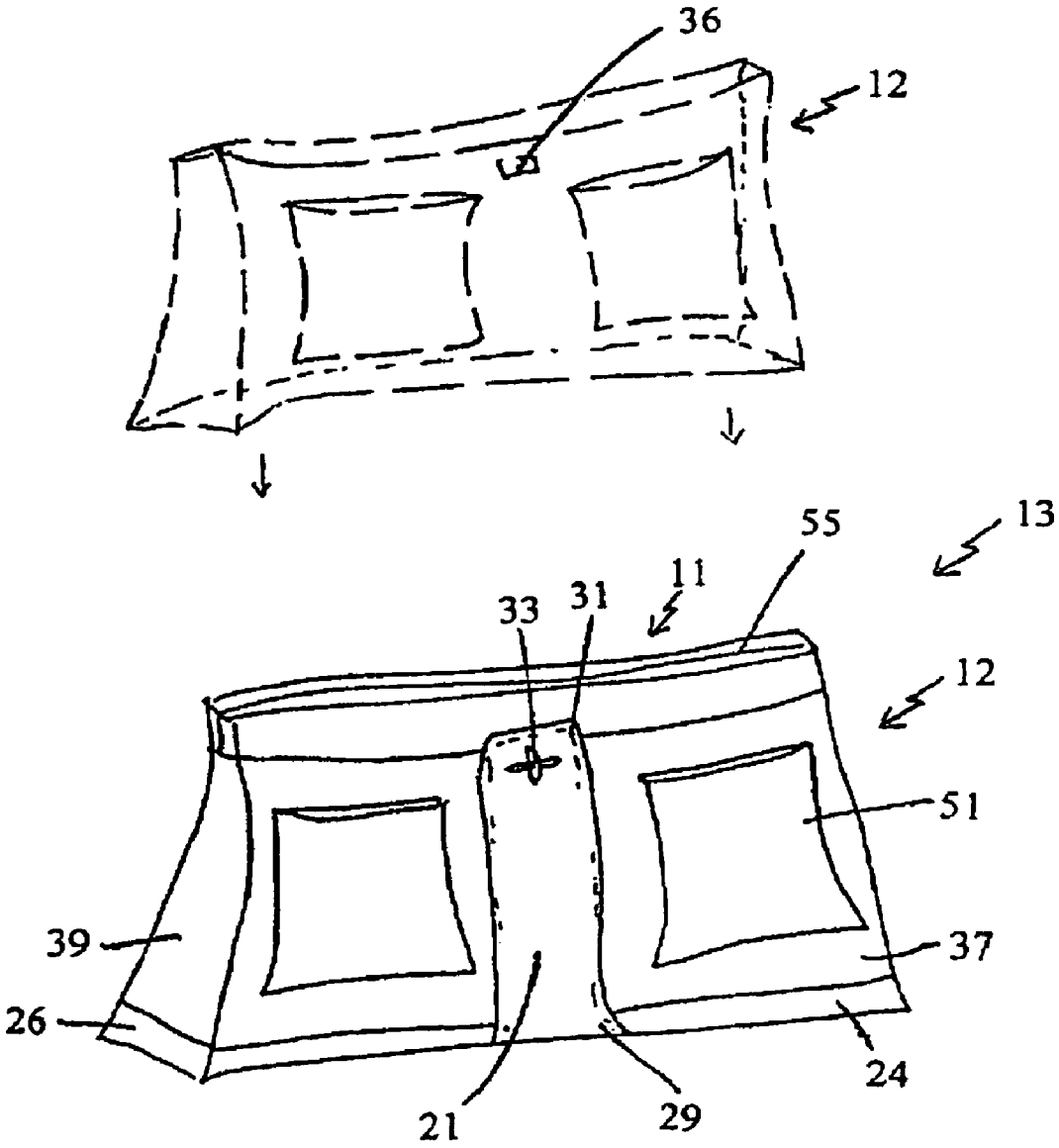
FIG. 9 is a perspective view of a clutch bag according to the present invention, shown with pockets on the overskirt.

Turning to FIG. 9, a clutch handbag 13 includes a clasp clutch opening 55 for closing its interior compartment. The clutch opening extends along the top panel 27 of the base bag. The attached end 29 of the front base fastening strap 21 is sewn into the bottom seam of the base bag, and the opposite, free end 31 of the base fastening strap 21 includes a strap aperture 34 through which a portion of the front attachment mechanism 33 is extendible.

In the clutch depicted in FIG. 9, the overskirt 12 is comprised of a front section 37, a rear section 38, and two end sections 39 that connect the front section to the rear section. Again, the overskirt 12 is open at the top and bottom, as seen in FIG. 9. The overskirt 12 comprises two front pockets 51 for enhancing the storage capabilities of the handbag 13. The overskirt 12 is preferably made of a fabric, most preferably denim.

A teen kit for pre-teenagers may include an overskirt 12 with one or more pockets 51, as shown in FIG. 9, and an autograph pen (not shown) attached at its top to a loop that is extendible from an overskirt pocket 51. The bag owner can draw on, or ask her friends to autograph, the overskirt 12 of her handbag 13 or knapsack according to the present invention. The overskirt 12, which is made of a suitable material, and the pen ink are optionally washable so the process can be repeated.

Figure 10:
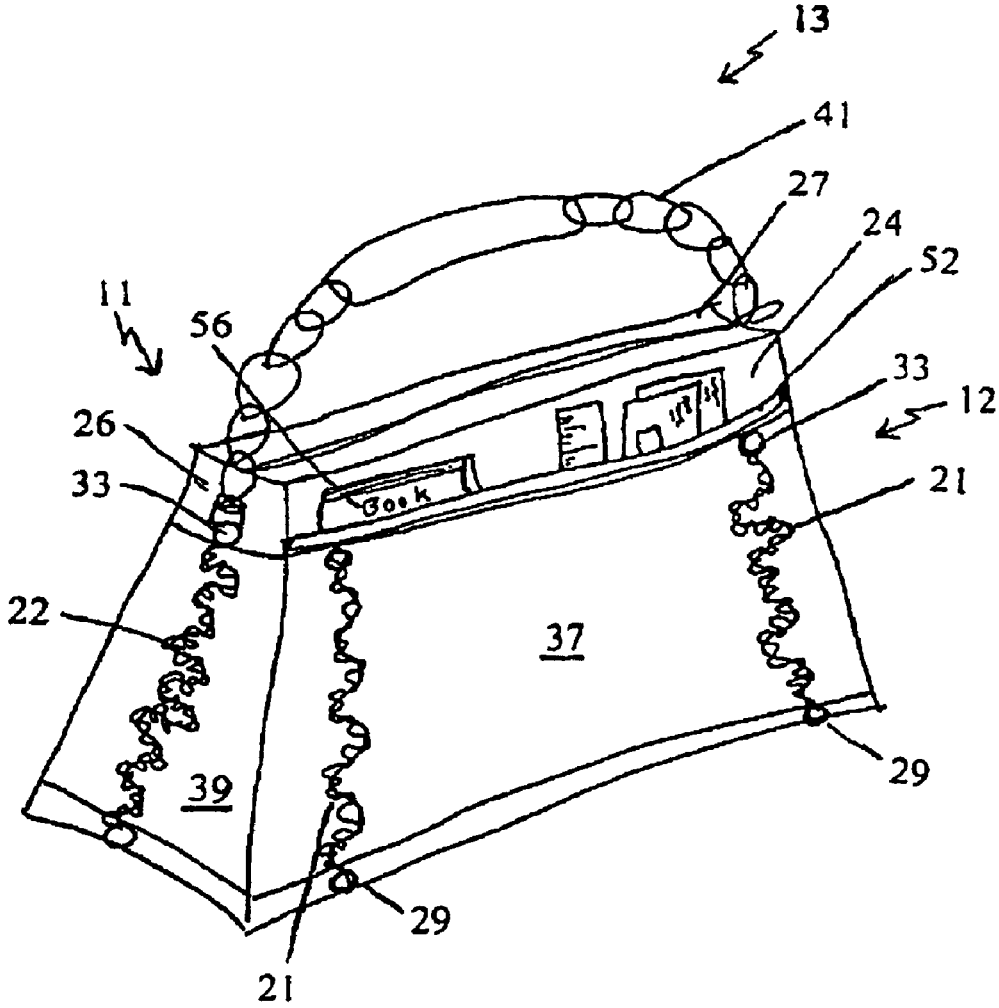
FIG. 10 is a perspective view of a handbag according to the present invention, shown with a pocket on the base bag.

Referring to FIG. 10, a handbag 13 includes a single handle 41 for carrying the handbag. The ends of the handles 41 are affixed to the top portion of the end panels 26 of the base bag 11. The handle 41 may be made of any suitable material, including leather, plastic, rope, chain, or hardware. A top bag opening, or mouth, extends the length of the top panel 27 of the base bag 11.

In the handbag of FIG. 10, the overskirt 12 is comprised of a front section 37, a rear section 38, and two end sections 39 that connect the front section to the rear section. The overskirt 12 is open at the top and bottom. The ends 29 of the two front and two end fastening straps 21, 22 are attached to the bottom of the front and end panels 24, 26 of the base bag, respectively. The opposite, free ends 31 of the fastening straps 21, 22 each include a member for attachment to an attachment mechanism 33 on the base bag 11. The attachment mechanism 33 may be, for example, a magnetic snap. The base bag 11 includes a base bag pocket 52 on its front panel 24 for storing personal items 56. The overskirt 12 and front base fastening straps 21 are made of a lightweight material so as not to impede use of the base bag pocket 52.

Figure 11:
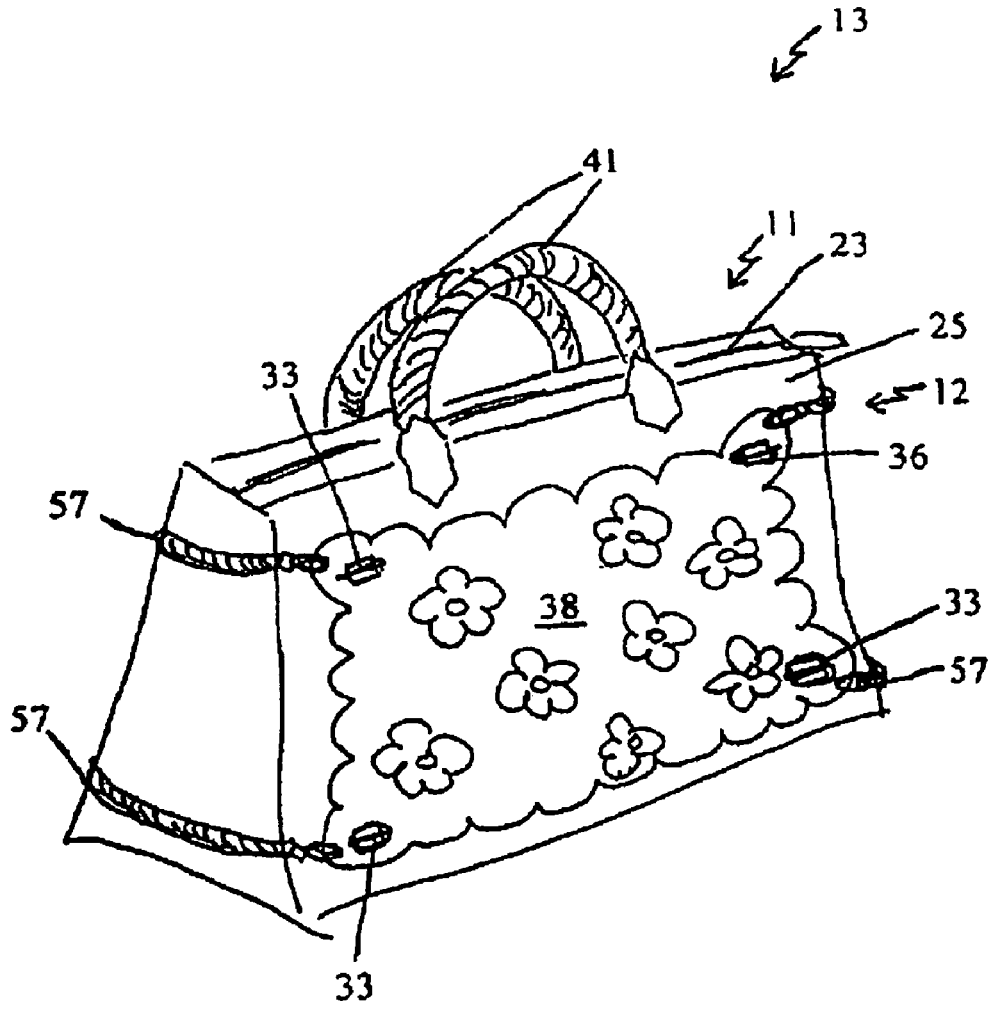
FIG. 11 is a perspective view of a handbag according to the present invention.

Turning to FIG. 11, a handbag 13 includes two rope-like handles 41 for carrying the handbag. The ends of the handles 41 are affixed to the top edges of the front and rear panels 24, 25 of the base bag 11. The handles 41 may be made of any suitable material, including leather, plastic, rope, chain, or hardware items. A conventional zipper 23 extends the length of the top panel 27 of the base bag. The overskirt is comprised of matching front and rear sections 37, 38 with scalloped edges for decoration. Four end cords 57 attach the front overskirt section 37 to the rear overskirt section 38, with two cords 57 at each end of the handbag 13. The front and rear overskirt sections 37, 38 each comprise four overskirt apertures 36 that fit directly over the four attachment mechanisms 33 (preferably turn fasteners) affixed to the front and rear panels 24, 25, respectively, of the base bag 11. No base fastening straps are included here.

Thus, the two-piece handbag 10 of FIG. 11 comprises:

(a) a base bag 11 comprising a front panel 24, a rear panel 25, and at least one central interior compartment 19;

(b) at least two attachment mechanisms 33, one attached to the front bag panel 24 and one attached to the rear bag panel 25 of the base bag 11;

(c) at least one removable, reversible overskirt 12 that fits closely over a substantial portion of the front and rear panels 24, 25 of the base bag 11, the overskirt 12 comprising a front section 37 and a rear section 38, and no top or bottom sections, the overskirt 12 comprising at least two apertures 36, each overskirt aperture 36 corresponding to one of the at least two attachment mechanisms 33.

Figure 12:
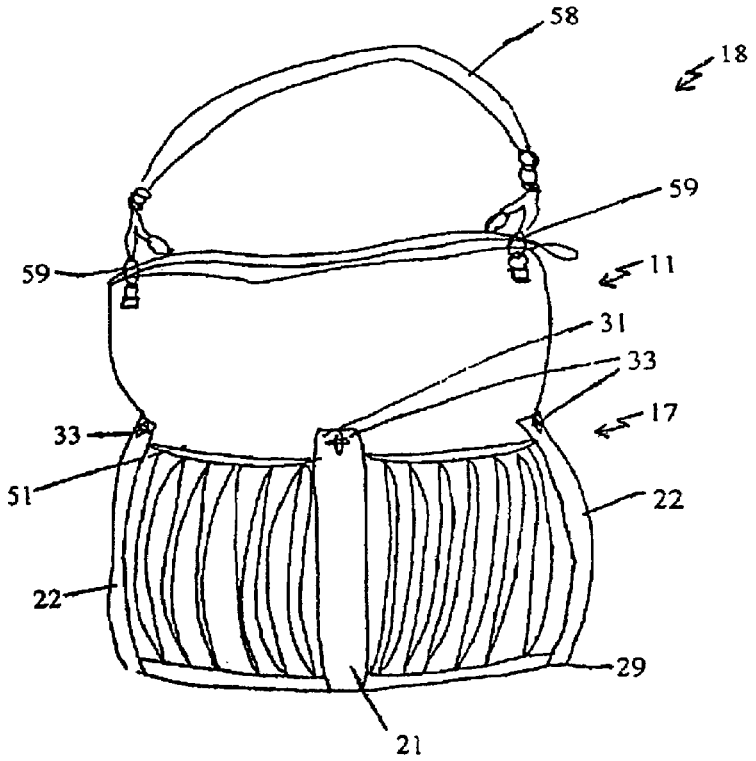
FIG. 12 is a perspective view of a beach bag according to the present invention, showing a removable fanny pack overskirt.
Figure 13:
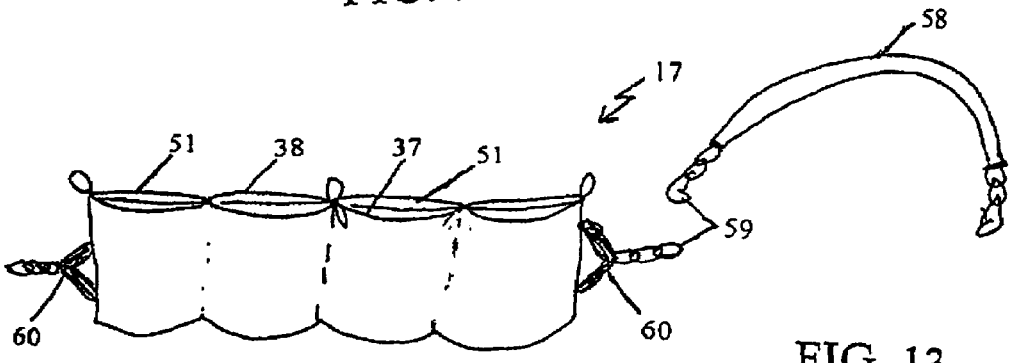
FIG. 13 is a perspective view of the fanny pack overskirt according to FIG. 12.

FIGS. 12 and 13 illustrate a relatively flexible beach bag 18 with a flexible, removable overskirt 12 that can be used separately around the waist or over the arm as a fanny pack. As seen in FIG. 12, the relatively unstructured base bag 11 comprises four base fastening straps 21, 22. The base fastening straps 21, 22 are attached at a lower, attached end 29 to the bottom of the base bag 11. The opposite, free ends 31 of the base fastening straps 21, 22 each include a strap aperture 34 that fits over an attachment mechanism 33 (fastener) affixed to the base bag 11 above the overskirt. Here, the overskirt, which is preferably made of terry cloth or another stretchy fabric, does not include apertures. The base fastening straps 21, 22 hold the overskirt in place on the base bag 11.

The overskirt comprises a front section 37 and a rear section 38, with at least two overskirt pockets 51 sewn in between the two. At opposite ends of the overskirt, matching belt sections 60 are attached. When the overskirt is in place on the base bag, the belt sections are tucked behind the overskirt so that they are not visible. The beach bag 18 includes a removable handle 58, which is attached to the base bag 11 by any suitable handle attachment mechanism 59, such as a hook and eye. The ends of the removable handle 58 are similarly attachable to the ends of the two belt sections 60 of the overskirt 12. The overskirt belt sections 60 and removable handle 58 permit the user to wear the fanny pack overskirt 17 around the waist or over the arm when it is not in use on the base bag 11.

To use it, the user attaches one end of the removable handle 58 to the end of one of the overskirt belt sections 60 via a handle attachment mechanism 59, fits the fanny pack overskirt 17 around his or her waist, and attaches the other, free end of the handle to the end of the other, free belt section 60 via the handle attachment mechanism 59. Personal items can be placed in the overskirt pockets 51 before or after the fanny pack overskirt 17 is around the waist. The belt sections 60 preferably include lengths of chain, as shown in FIG. 13, so that the fanny pack overskirt 17 can be adapted to fit on different sized waists.

Thus, the beach bag 18 can be carried to the beach with towels, caps, etc. in the central compartment 19, and more valuable items, such as money, credit cards, and keys, in the overskirt pockets 51. The user can unfasten the base fastening straps 21, 22, remove the fanny pack overskirt 17 and carry it to the snack bar, grocery store, etc. without having to carry the heavier base bag 11 everywhere. The overskirt 12 is easily replaced on the base bag.

Figure 14:
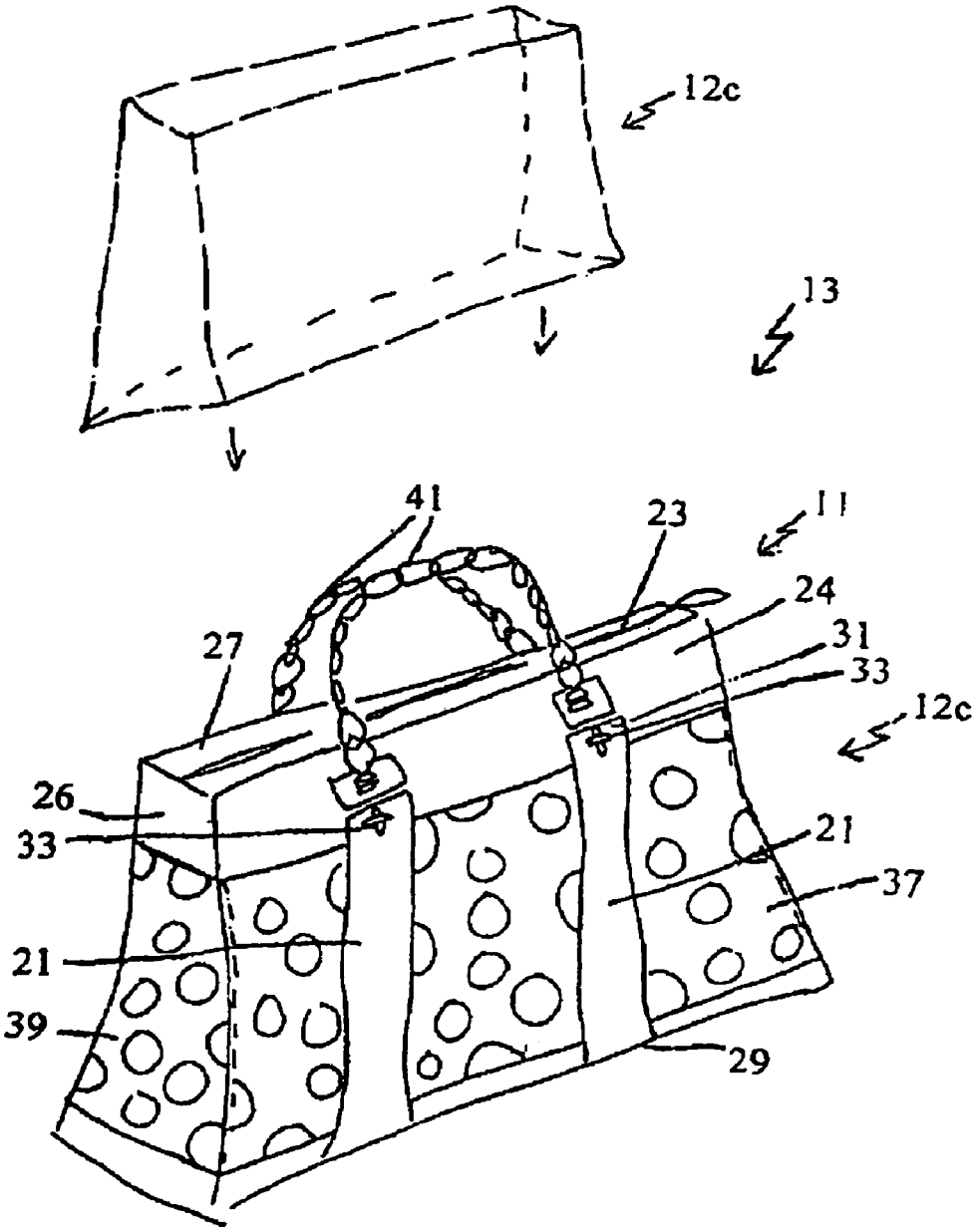
FIG. 14 is a perspective view of a handbag according to the present invention.

In regard to FIG. 14, a handbag 13 includes a structured overskirt 12*c* without any apertures. The ends of the two chain handles 41 of the base bag are affixed to the top edges of the front and rear panels 24, 25 of the base bag 11. A conventional zipper 23 extends the length of the top panel 27 of the base bag.

The base bag 11 comprises two front base fastening straps 21, which are affixed at their lower, attached ends 29 to the bottom of the base bag 11. Strap apertures in the free ends 31 of the two base fastening straps 21 fit over a portion of the attachment mechanisms 33, which are affixed to the base front panel 24.

The overskirt 12*c* is comprised of four adjacent sections: a front section 37 and a rear section 38, each attached to two end sections 39. The overskirt 12*c* is open at the top and bottom. The overskirt 12*c* is substantially stiff and free-standing, so that it quickly and easily slides over the base bag. As shown in FIG. 14, rigid corners on the overskirt 12*c* and base bag 11 prevent the overskirt from sliding around the base bag. The rear of the handbag 13 has the same appearance as the front.

The carrying strap 20 or handle 41 of the present invention is preferably not used to attach the overskirt 12 to the base bag 11. The overskirt 12 does not comprise any attachment mechanism for attaching the overskirt 12 to the base bag 11. The zipper 23, if there is one, is for closing the base bag 11 and not for attaching the overskirt 12 to the base bag. The carrying bag 10 preferably does not include skeleton or frame pieces.

The overskirt 12 is open at the bottom, and does not cover the bottom of the base bag 11. The overskirt 12 is a skirt rather than a pocket or pouch. The overskirt 12 does not conceal, or occlude, the entire rear and/or front panels of the base bag 11. The overskirt 12 also has an open top and does not fit over, or occlude, the top of the base bag 11. The overskirt 12 is not hinged onto the base bag 11. When it is in use, the one piece overskirt 12 partially covers both the front and rear panels of the one piece base bag 11. Where the overskirt 12 is made of a flexible material, it can be stored in the base bag 11 until the user decides to slip it over the exterior of the base bag. This is particularly useful for converting a day purse to an evening bag without having to return home and transfer purses.

Also included herein is a kit for assembling a customized handbag 13. This handbag kit comprises:

(a) a base bag 11 comprising at least one central interior compartment 19 and at least one exterior base fastening strap 21, the base fastening strap 21 being attached at one end to the base bag 11, at least one attachment mechanism 33 being attached to the base bag; and (b) at least two reversible, removable overskirts 12, each overskirt 12 comprising at least one aperture 36, the overskirt 12 fitting closely over an exterior of the base bag 11, the base fastening strap 21 extending over a substantial portion of the overskirt 12;

wherein the attachment mechanism 33 corresponds to the aperture 36 of the overskirt 12. In the kit, the base fastening strap 21 is removably attachable at an opposite end 31 to the attachment mechanism 33. No tools are needed to assemble the handbag.

With any of the carrying bags 10 described herein, more than one overskirt 12 can be worn on a base bag 11 at the same time. For example, an outer overskirt comprising apertures may be worn over a somewhat larger inner overskirt made of a colorful material that shows through the apertures in the outer overskirt. In particular, the color of the inner overskirt may show through cut-outs in an outer overskirt made of an eyelet, slashed fabric, or chain material.

From the foregoing it can be realized that the described device of the present invention may be easily and conveniently utilized as a carrying bag with a reversible overskirt. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 carrying bag
11 base bag
12 overskirt
13 handbag
14 computer bag
15 diaper bag
16 tote bag
17 fanny pack overskirt
18 beach bag
19 central interior compartment
20 carrying strap
21 front and rear base fastening straps
22 end base fastening straps
23 zipper
24 base bag front panel
25 base bag rear panel
26 base bag end panels
27 base bag top panel
28 end buckle
29 attached end of front/rear base fastening straps
30 attached end of end base fastening straps
31 free end of front/rear base fastening straps
32 free end of end base fastening straps
33 attachment mechanism
34 aperture in front/rear base fastening straps
35 ends of shoulder strap
36 overskirt aperture
37 overskirt front section
38 overskirt rear sections
39 overskirt end sections
40 end buckle strap
41 carrying handles
42 chains
43 decorative studs
44 end pockets
45 end pocket flaps
46 bikini strips

47 female clasp member
48 male clasp member
49 draw cord
50 hook and loop strips
51 overskirt pockets
52 base bag pocket
53 elasticized overskirt insert
54 computer base bag flap
55 clasp clutch opening
56 personal items
57 end cords
58 removable handle
59 handle attachment mechanism
60 overskirt belt section

What is claimed is:

1. A versatile, two-piece carrying bag comprising: (a) a base bag comprising at least one central interior compartment and at least one exterior base fastening strap, the at least one base fastening strap being attached at a first end of the base fastening strap to the base bag; (b) a removable overskirt that fits closely over an exterior of the base bag, the overskirt being open at the top and bottom, the base fastening strap extending over a substantial portion of the overskirts when the overskirt is on the base bag; (c) at least one attachment mechanism attached to the base bag for removably attaching the overskirt to the base bag, the at least one base fastening strap being removably attachable at an opposite, second end of the base fastening strap to the at least one attachment mechanism; and (d) at least one end strap fastening mechanism on the base bag, and at least one end fastening strap attachable to the at least one end strap fastening mechanism; wherein a first end of the at least one end fastening strap is attached to a bottom portion of an end panel of the base bag, a second, opposite end of the at least one end fastening strap being removably attachable to the at least one end strap fastening mechanism; wherein the overskirt does not comprise any attachment mechanism for attaching the overskirt to the base bag; wherein an opposite, second end of the at least one base fastening strap of the base bag comprises a strap aperture; and wherein the at least one base bag attachment mechanism is a toggle attachment attached to a front or rear panel of the base bag, the toggle of the at least one attachment mechanism being insertable through the strap aperture.

2. The carrying bag according to claim 1, wherein the overskirt is reversible.

3. The carrying bag according to claim 1, wherein the end strap fastening mechanism is a buckle.

4. The carrying bag according to claim 1, wherein the overskirt comprises at least one aperture that corresponds to at least a portion of the at least one attachment mechanism of the base bag, a portion of the at least one attachment mechanism being insertable through the at least one aperture of the overskirt.

5. The carrying bag according to claim 4, further comprising at least one carrying strap or handle attached to the base bag and not the overskirt, and the base bag is usable as a carrying bag on its own.

6. The carrying bag according to claim 5, wherein the carrying bag is a handbag, the top opening of the overskirt is smaller in size than the bottom opening of the overskirt, and the overskirt is slidable over the at least one carrying strap or handle.

7. The carrying bag according to claim 6, wherein the overskirt comprises four sections, the four sections comprising a front section and a rear section, each attached to two same-sized end sections of the four sections, the front and rear sections being the same size as one another.

8. The carrying bag according to claim 7, wherein the front and rear sections comprise two of the at least one overskirt apertures, the apertures being positioned opposite one another on the overskirt.

9. A two-piece carrying bag comprising: (a) a base bag comprising at least one central interior compartment and at least one exterior base fastening strap, the at least one base fastening strap being attached at a first end of the base fastening strap to the base bag; (b) a removable overskirt that fits closely over an exterior of the base bag, the overskirt being open at the top and bottom, the base fastening strap extending over a substantial portion of the overskirt when the overskirt is on the base bag; (c) at least one attachment mechanism attached to the base bag for removably attaching the overskirt to the base bag, the at least one base fastening strap being removably attachable at an opposite, second end of the base fastening strap to the at least one attachment mechanism; and (d) two end strap fastening mechanisms on the base bag, and two end fastening straps attachable to the end strap fastening mechanisms; wherein a first end of at least one of the end fastening straps is attached to a bottom portion of an end panel of the base bag, a second, opposite end of at least one of the end fastening straps being removably attachable to at least one of the end strap fastening mechanisms; wherein the overskirt does not comprise any attachment mechanism for attaching the overskirt to the base bag; and wherein one of the end fastening straps and one of the end strap fastening mechanisms are on each end panel of the base bag.

10. A kit for assembling a customized handbag, the kit comprising: (a) a base bag comprising at least one central interior compartment and at least one exterior base fastening strap, the at least one base fastening strap being attached at a first end of the base fastening strap to the base bag, at least one attachment mechanism being attached to the base bag; and (b) at least two reversible, removable overskirts, each overskirt comprising at least one aperture, the overskirt fitting closely over an exterior of the base bag, the at least one base fastening strap extending over a portion of the overskirt when the overskirt is in use on the base bag; wherein the at least one attachment mechanism corresponds to the at least one aperture of the overskirt, the at least one base fastening strap being removably attachable at an opposite, second end of the base fastening strap to the at least one attachment mechanism; and the overskirt does not comprise an attachment mechanism; and further comprising two end strap fastening mechanisms on the base bag, and two end fastening straps attachable to the end strap fastening mechanisms, a first end of the end fastening straps being attached to a bottom portion of an end panel of the base bag, a second, opposite end of the end fastening straps being removably attachable to one of the end strap fastening mechanisms, with one of the end fastening straps and one of the end strap fastening mechanisms on each of the end panels of the base bag.

* * * * *